US006851683B2

(12) United States Patent
Wegener

(10) Patent No.: US 6,851,683 B2
(45) Date of Patent: Feb. 8, 2005

(54) ADJUSTABLE IN-LINE SKATE

(76) Inventor: Andreas C. Wegener, 3204 Rim Rock Cir., Encinitas, CA (US) 92024

( * ) Notice: Subject to any disclaimer, the term of this patent is extended or adjusted under 35 U.S.C. 154(b) by 71 days.

(21) Appl. No.: 10/287,921

(22) Filed: Nov. 4, 2002

(65) Prior Publication Data

US 2004/0084862 A1 May 6, 2004

(51) Int. Cl.[7] ..... A63C 17/06

(52) U.S. Cl. ..... 280/11.26; 280/11.3; 280/11.224; 280/11.16; 280/11.27

(58) Field of Search ..... 280/11.26, 11.3, 280/11.19, 11.221, 11.223, 11.224, 11.14, 11.16, 11.27, 115, 117.1

(56) References Cited

U.S. PATENT DOCUMENTS

| | | | | | |
|---|---|---|---|---|---|
| 1,547,531 | A | * | 7/1925 | Staples | 280/11.27 |
| 1,597,213 | A | * | 8/1926 | Staples | 280/11.26 |
| 2,572,050 | A | | 10/1951 | Ornstein | |
| 3,229,989 | A | | 1/1966 | Papangelis | |
| 3,389,481 | A | | 6/1968 | England | |
| 3,431,658 | A | | 3/1969 | Finn | |
| 3,541,708 | A | | 11/1970 | Rosen | |
| 3,645,017 | A | | 2/1972 | Hickman | |
| 3,686,777 | A | | 8/1972 | Rosen | |
| 3,858,337 | A | | 1/1975 | Vogel | |
| 3,963,252 | A | * | 6/1976 | Carlson | 280/11.223 |
| 3,993,318 | A | * | 11/1976 | Rothmayer | 280/11.26 |
| 4,060,918 | A | | 12/1977 | Mandel | |
| 4,083,128 | A | | 4/1978 | Rossman | |
| 4,120,103 | A | | 10/1978 | Colby | |
| 4,126,323 | A | | 11/1978 | Scherz | |
| 4,334,690 | A | * | 6/1982 | Klamer et al. | 280/11.201 |
| 4,708,352 | A | | 11/1987 | Vullierme | |
| 4,747,221 | A | | 5/1988 | Hayes | |
| 4,773,886 | A | | 9/1988 | Teeter et al. | |
| D300,049 | S | | 2/1989 | Klamer et al. | |
| 4,959,914 | A | | 10/1990 | Hilgarth | |
| 5,046,746 | A | | 9/1991 | Gierveld | |
| 5,092,614 | A | | 3/1992 | Malewicz | |
| D326,700 | S | | 6/1992 | Brown et al. | |
| D333,171 | S | | 2/1993 | Gertler | |
| 5,184,834 | A | * | 2/1993 | Yu | 280/7.13 |
| D344,316 | S | | 2/1994 | Gertler | |
| D347,237 | S | | 5/1994 | Robjent et al. | |
| D353,429 | S | | 12/1994 | Gay et al. | |
| 5,397,141 | A | | 3/1995 | Hoshizaki et al. | |
| 5,421,596 | A | * | 6/1995 | Lee | 280/11.19 |
| 5,484,149 | A | | 1/1996 | Lee | |
| 5,498,009 | A | * | 3/1996 | Young | 280/11.12 |

(List continued on next page.)

FOREIGN PATENT DOCUMENTS

| | | |
|---|---|---|
| BR | 674292 | 6/1952 |
| DE | 597644 | 5/1934 |
| DE | 27 49 887 A1 | 8/1978 |
| DE | 28 00 626 A1 | 7/1979 |
| EP | 0 215 744 B1 | 4/1990 |
| EP | 0 443 293 A1 | 2/1991 |
| EP | 0 551 704 A2 | 7/1993 |
| EP | 0 356 398 B1 | 3/1995 |
| FR | 1266620 | 6/1961 |
| FR | 2561115 | 9/1985 |
| FR | 2614547 | 11/1988 |
| WO | WO 80/02789 | 12/1980 |
| WO | WO 92/09340 | 6/1992 |
| WO | WO 92/18023 | 10/1992 |
| WO | WO 94/14350 | 7/1994 |

*Primary Examiner*—Christopher P. Ellis
*Assistant Examiner*—J. Allen Shriver
(74) *Attorney, Agent, or Firm*—Gordon & Rees LLP

(57) ABSTRACT

An adjustable in-line skate has a rigid frame, a plurality of wheels rotatably secured to the frame in a line, a sole plate secured to the frame having a heel portion and a toe portion, and a boot mounted on the sole plate. The boot has a toe shell and a separate heel shell. The heel and toe shells are each adjustably secured to the sole plate for adjustment of the overall length of the boot, so that two separate adjustment points are provided.

20 Claims, 5 Drawing Sheets

U.S. PATENT DOCUMENTS 5,566,475 A 10/1996 Donnadieu
5,645,288 A * 7/1997 Lu ..... 280/11.26
5,678,833 A 10/1997 Olson et al.
5,741,018 A 4/1998 Huang
5,794,362 A 8/1998 Polk, III et al.
5,836,592 A 11/1998 Chang
5,887,877 A * 3/1999 Nero ..... 280/11.221
5,913,526 A * 6/1999 Olson et al. ..... 280/11.231
6,045,144 A * 4/2000 Wong ..... 280/11.26
6,050,574 A * 4/2000 Olson et al. ..... 280/11.231
6,217,039 B1 4/2001 Iverson et al.
6,276,697 B1 8/2001 Lin
6,497,420 B2 * 12/2002 Ricci ..... 280/11.16
2001/0015534 A1 * 8/2001 Iverson et al. ..... 280/11.26
2002/0158428 A1 * 10/2002 Lin ..... 280/11.221
2003/0116929 A1 * 6/2003 Chen ..... 280/11.26

* cited by examiner

2/5.

ADJUSTABLE IN-LINE SKATE

BACKGROUND OF THE INVENTION

The present invention relates to a single-track roller skate of the type generally known as "in-line skates", and is particularly concerned with an adjustable in-line skate in which the size can be adjusted to accommodate growth in the foot size of a youth, for example.

An in-line roller skate generally comprises a boot having a sole, and chassis or frame attached to the sole of the boot on which a series of wheels are rotatably mounted in a line. In-line skates in which the size of the boot can be adjusted are known in the field. However, for the most part, such skates have a boot in which the toe part is adjustably secured directly to the heel part. This means that it is difficult to maintain proper centering of the foot relative to the wheel frame when adjustments are made, and stability is reduced by having a toe to heel adjustment point on the boot. One such adjustable in-line skate is described in U.S. Pat. No. 5,678,833 of Olson, in which the skate boot has a heel part secured to the wheel frame, and a toe part adjustably secured to the heel part. U.S. Pat. No. 5,836,592 of Chang describes a skate boot in which the toe is slidably engaged with the remainder of the boot, which is in a fixed position on the wheel frame. Similar arrangements are described in U.S. Pat. No. 6,045,144 of Wong and U.S. Pat. No. 5,794,362 of Polk, III.

SUMMARY OF THE INVENTION

It is an object of the present invention to provide a new and improved adjustable in-line skate.

According to the present invention, an adjustable in-line skate is provided, which comprises a rigid frame, a plurality of wheels rotatably secured to the frame in a line, the frame having an upper side facing away from the wheels, a one-piece sole plate having a heel portion and a toe portion, and a boot comprising a toe shell and a separate heel shell, the heel and toe shells being separately and adjustably secured to the sole plate for adjustment of the overall length of the boot, and the sole plate being secured to the upper side of the wheel frame.

With this arrangement, rather than adjustably securing a toe shell to a heel shell with one adjustment point, the heel and toe shells are each separately and adjustably mounted on the unitarily formed rigid sole plate. This means that the boot is axially adjustable in both axial directions, i.e. to the rear by adjusting the heel shell relative to the sole plate, and to the front by adjusting the toe shell relative to the sole plate. The arrangement is more stable for grinding maneuvers due to the one piece sole plate, which may have raised rims for increased grinding surfaces.

In one exemplary embodiment, a first single bolt extends through aligned openings in the upper side of the wheel frame, the sole plate, and the heel shell and a second single bolt extends through a second set of aligned openings in the upper side of the wheel frame, the sole plate, and the toe shell. Each bolt has a head at one end and a nut at the other end for tightening when the heel or toe shell are at the desired position on the sole plate. One of the openings in the shell or sole plate in each set is axially extended to permit the desired amount of adjustment. The wheel frame and sole plate may be formed unitarily, with the upper wall of the wheel frame extended to form the sole plate or support platform for the adjustable boot shells.

The adjustable in-line skate of this invention permits the boot always to be properly centered relative to the wheels or rollers, since both the heel and the toe shell can be extended in opposite directions relative to the sole plate for adjustment of the overall boot size, permitting the overall boot to remain in a central position. The solid, one-piece sole plate is very stable for grinding maneuvers, while the provision of two separate adjustment points, one between the sole plate and heel shell, and one between the sole plate and toe shell, allows for a greater amount of adjustability than the prior art.

BRIEF DESCRIPTION OF THE DRAWINGS

The present invention will be better understood from the following detailed description of an exemplary embodiment of the invention, taken in conjunction with the accompanying drawings in which like reference numerals refer to like parts and in which.

DETAILED DESCRIPTION OF THE DRAWINGS

Figure 1:
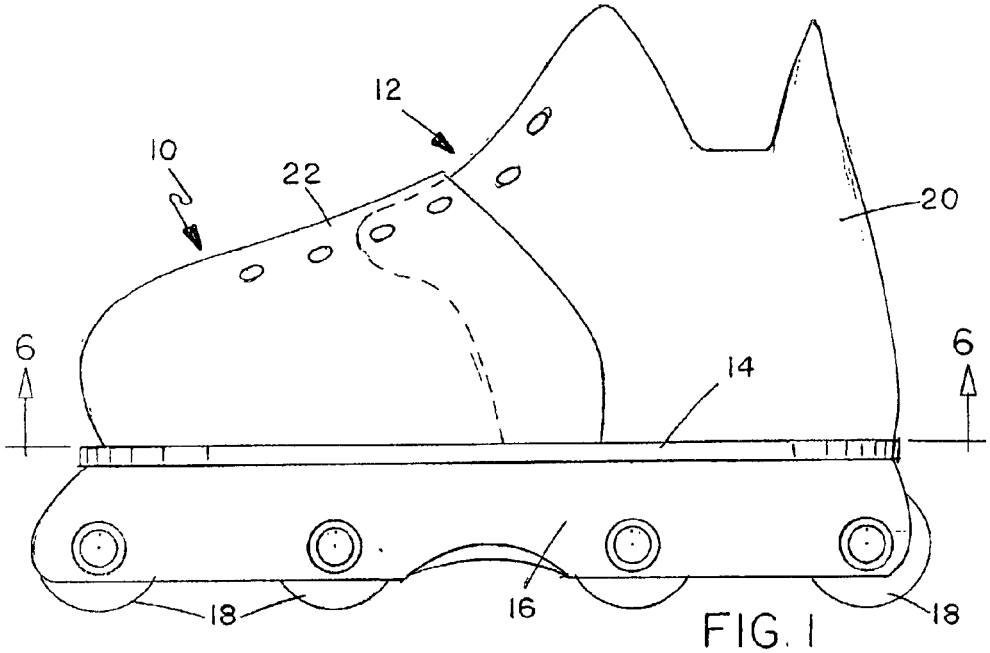
FIG. 1 is a side view of an adjustable in-line skate according to an exemplary embodiment of the invention, incorporating the adjustable toe and heel shells.
Figure 2:
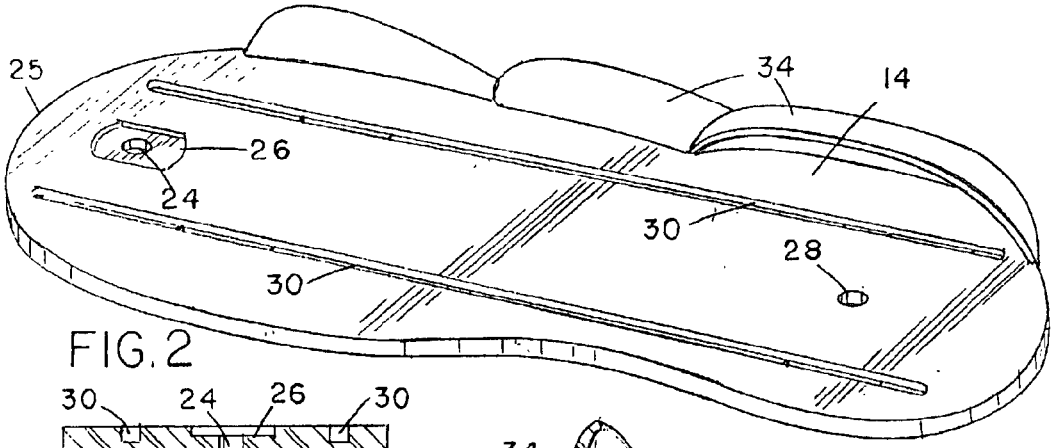
FIG. 2 is a perspective view showing the top surface of the sole plate.
Figure 4:
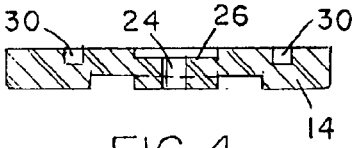
FIG. 4 is a sectional view taken on line 4—4 of FIG. 3.
Figure 5:
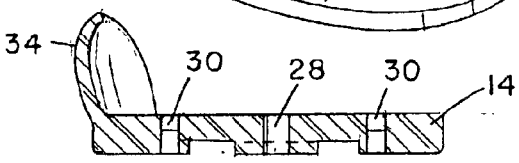
FIG. 5 is a sectional view taken on line 5—5 of FIG. 3.
Figure 3:
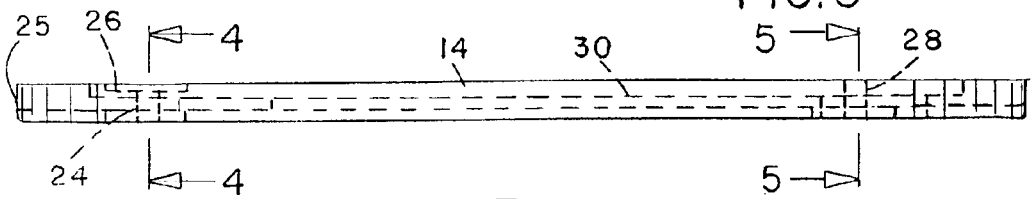
FIG. 3 is a side view of the sole plate.

FIG. 1 of the drawings illustrates an adjustable in-line skate 10 according to an exemplary embodiment of the present invention, while FIGS. 2 to 9 illustrate details of various parts of the skate 10. Skate 10 basically comprises a two part boot 12, a one piece sole plate or frame 14, a wheel mounting frame 16, and a plurality of wheels or rollers 18 rotatably mounted in line in the frame 16. The boot 12 comprises a heel part or shell 20 and a toe part or shell 22 which are each adjustably secured to the sole plate 14 at spaced locations in order to vary the overall length of the boot, as described in more detail below.

As best illustrated in FIGS. 2 to 5, the sole plate 14 is a rigid, one piece plate member having a contour which generally follows the contour of the sole of a shoe or boot, and which has a first through bore or hole 24 adjacent the toe end 25 set in an indented portion 26, and a second through bore or hole 28 in the heel region. Both holes lie on the central longitudinal axis of the sole plate. The overall length of the sole plate will correspond to the minimum length of the boot when the two shells are adjusted to a minimum possible extension. Two parallel, upwardly facing slots or guide grooves 30 are provided on the upper face of plate 14 on opposite sides of the holes 24,28. The outer side edge of the plate has raised portions 34 which will engage over the outer side of the boot 10 and provide protective surfaces against grinding damage.

Figure 6:
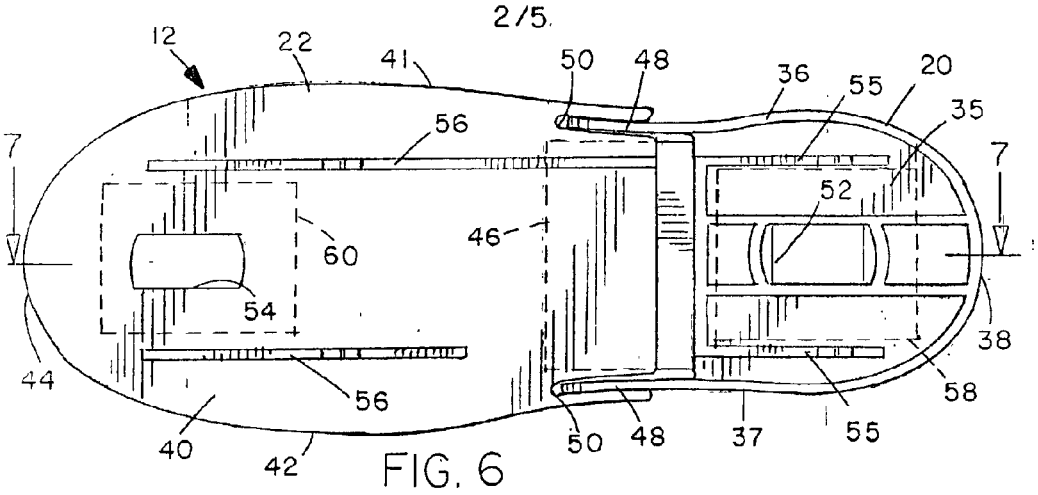
FIG. 6 is a bottom view of the interfitted toe and heel shells as taken on line 6—6 of FIG. 1.
Figure 7:
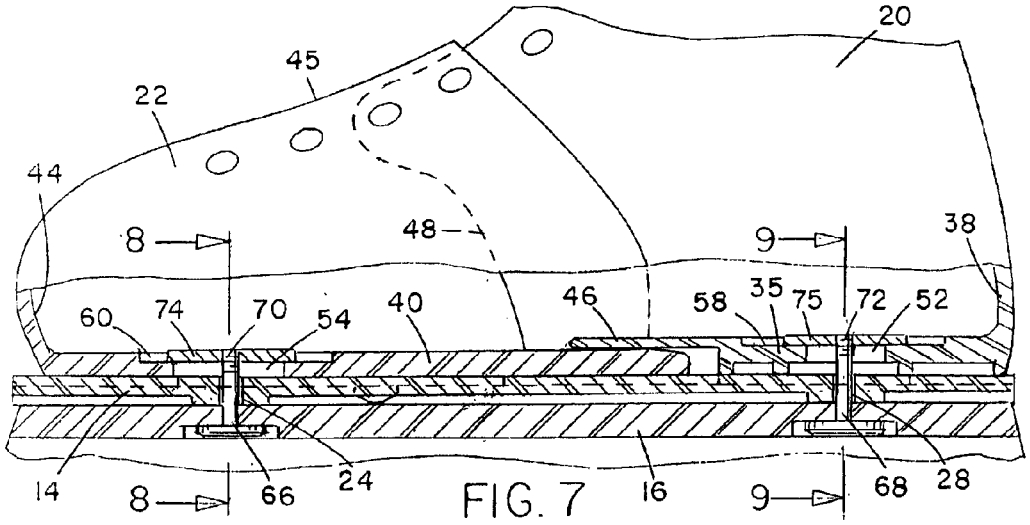
FIG. 7 is a sectional view taken on line 7—7 of FIG. 6, with the sole plate and a portion of the wheel frame added.

As best illustrated in FIGS. 1, 6 and 7, the heel shell 20 of the boot is shaped so as to enclose the heel of a wearer's foot, and has an ankle cuff, a sole portion 35, opposite inner and outer side walls 36,37, and a rear end wall 38. The toe shell 22 has a sole portion 40, opposite inner and outer side walls 41,42, and a front or toe end wall 44, as well as an upper wall portion 45 for extending over the toe end of a wearer's foot. The heel shell 20 has a lower tongue 46 and opposite side tongues 48 which project forwardly from the sole portion 35 and side walls, as best illustrated in FIGS. 6 and 7. The lower tongue 46 projects inwardly into the toe part over the sole portion 40, as indicated in FIG. 7. Each side tongue 48 projects forwardly and engages a notch or slot 50 extending inwardly from the end of the sole portion adjacent the respective side wall 41,42 of the toe shell 22. The tongues 46,48 can slide inwardly or outwardly relative to the toe shell in order to adjust the overall length of the boot to accommodate growth in a child's foot, for example, while still completely enclosing the foot. A suitable sock or liner of pliable material will be provided for the boot, as is well-known in in-line skate boots. The liner will be of stretchable material to accommodate changes in boot size.

Figure 8:
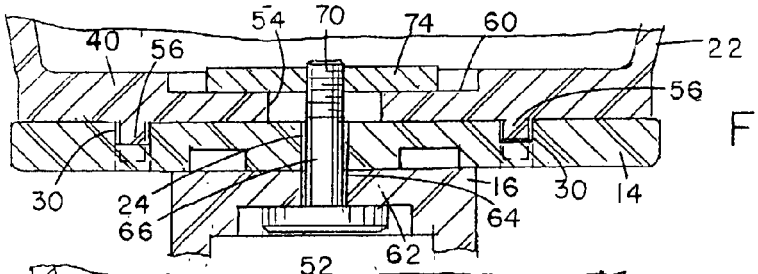
FIG. 8 is an enlarged sectional view taken on line 8—8 of FIG. 7.
Figure 9:
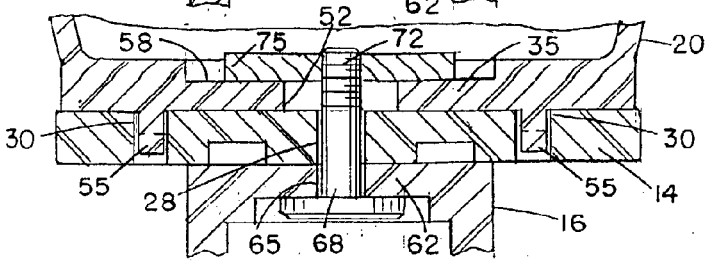
FIG. 9 is an enlarged sectional view taken on line 9—9 of FIG. 7.

The sole portion 35 of the heel shell has a centrally located, axially extending slot 52 which is designed for alignment with through hole 28 in the sole plate. Similarly, sole portion 40 of the toe shell has a centrally located, axially extending slot 54 which is designed for alignment with through hole 24 in the sole plate, as indicated in FIG. 7. As indicated in FIGS. 6 and 9, the lower surface of sole portion 35 has side ribs 55 on opposite sides of slot 52 designed for sliding engagement in the guide grooves 30 of the sole plate. Similarly, the lower surface of sole portion 40 has opposite side ribs 56 which are also slidably engaged in grooves 30, as best illustrated in FIG. 8. The engagement of the ribs in the grooves will enhance the stability of the boot shells, while ensuring proper positioning of the shells when adjustments are carried out.

Each elongate slot 52,54 is located in a generally square or rectangular recess 58,60, respectively, in the upper face of the respective sole portion 35,40, as best illustrated in FIGS. 8 and 9. The wheel mounting frame 16 has an upper wall 62 with a pair of spaced, recessed through holes 64,65, respectively, located for alignment with the respective holes 24,28 in the sole plate. Bolts 66, 68 extend through the two sets of aligned holes 64, 24, 54 and 65, 28, 52, respectively with nuts 74, 75 secured to the threaded ends 70, 72 of the respective bolts to releasably secure the parts together.

As indicated in FIGS. 7 to 9, the skate is assembled by placing sole plate 14 over the frame upper wall 62 with the respective holes 64,24 and 65,28 in alignment, and a respective bolt 66,68, respectively, is inserted through the pairs of holes from underneath the frame upper wall, with the head of each bolt engaging in the respective recess surrounding holes 64,65 respectively, and the threaded ends 70,72 of the bolt shafts extending upwardly through the holes in the sole plate. The boot 20 is then placed over the sole plate 14 such that the threaded ends 70,72 of the bolts project upwardly through the slots 54 and 52, respectively, and the ribs 55,56 engage in the guide grooves 30 on the upper surface of the sole plate. Nuts 74,75 are then engaged over the respective bolt ends 70,72 to secure the parts together, and the nuts can be tightened to secure the toe part 22 and sole part 20 rigidly to the sole plate 14 and wheel guide frame 16, as indicated in FIGS. 7 to 9.

If the length of the boot is to be adjusted, for example to accommodate a wearer with a slightly different sized foot or a child's change in shoe size, the nuts 74 and 75 can be loosened and the heel part 20 and toe part 22 can then both be moved axially in an inward or outward direction relative to the sole plate 14, with the bolt shafts sliding along the respective slots 52 and 54 and the ribs 55,56 sliding along the guide grooves 30. Once the desired boot length has been achieved, the nuts 74 and 75 are again tightened to secure the boot at its adjusted length. The length of the sole plate corresponds to the minimum boot size or length.

Figure 10:
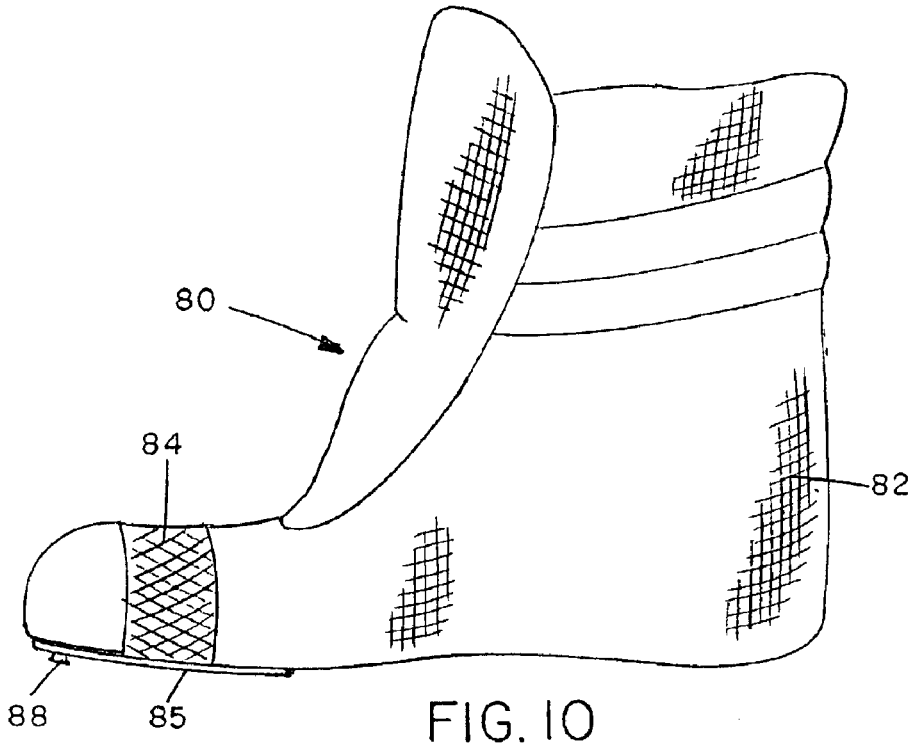
FIG. 10 is a side view of a fabric boot liner with an elastic expansion insert and an attached toe retainer for use with the adjustable inline skate of FIGS. 1 to 9.
Figure 11:
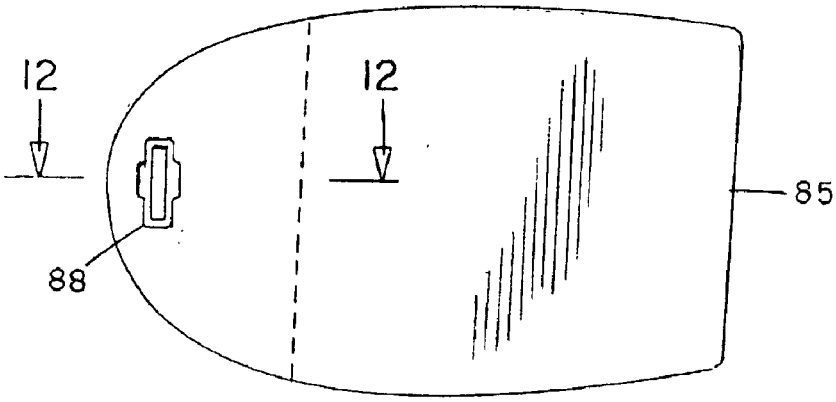
FIG. 11 is a bottom view of the toe retainer.
Figure 12:
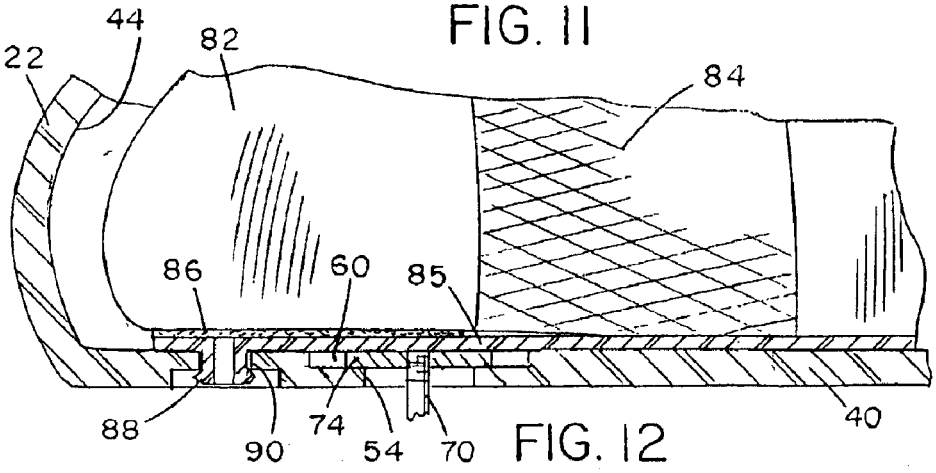
FIG. 12 is an enlarged sectional view taken on line 12—12 of FIG. 11, showing the liner and retainer engaged in the toe shell of the boot of FIGS. 1 to 9.

FIGS. 10 to 12 illustrate an optional liner assembly 80 for use in the adjustable boot assembly of FIGS. 1 to 9. The liner assembly 80 comprises a sock or liner 82 of soft, padded and pliable material for fitting inside the boot 12, with an elastic insert 84 in the toe portion of the boot so that it can stretch to accommodate changes in length of the boot. A plate or toe retainer 85 is secured to the undersurface of the sole of the liner at the toe end of the liner, either by adhesive 86 or by sewing it into a suitable pocket in the liner. The plate 85 has a downwardly projecting latch member 88 adjacent the toe.

The sole portion 40 of the toe shell 22 is modified to provide a latch receiving opening 90 for snap engagement with latch member 88 when the liner or sock 82 is inserted into the boot, as illustrated in FIG. 12. This connects the liner to the boot so that the toe portion of the liner will be stretched as the toe shell 22 is moved forwardly to extend the length of the boot.

FIGS. 13 to 17 of the drawings illustrate a modified adjustable skate 100 according to another embodiment of the invention. Some parts of the skate 100 are identical to the previous embodiment, and like reference numerals have been used for like parts as appropriate. As in the previous embodiment, the skate 100 comprises a two part boot having a toe shell 102 and a heel shell 104 adjustably mounted on a one piece sole plate 105. A wheel mounting frame 16 and rollers or wheels 18 will be secured to the undersurface of sole plate 105, as in the first embodiment. However, the interlocking arrangement between the shells 102,104 and the sole plate 105 is different from the previous embodiment.

Figure 13:
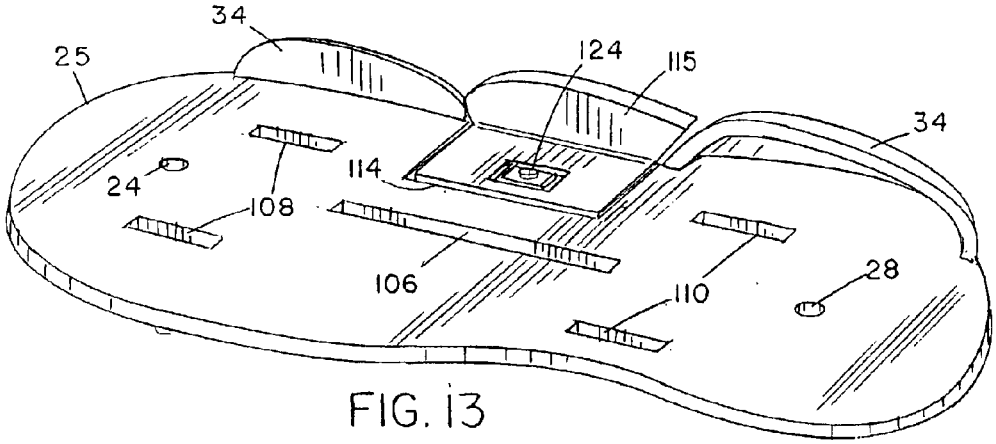
FIG. 13 is a view similar to FIG. 2, showing modified sole plate with an alternative interlocking arrangement.
Figure 17:
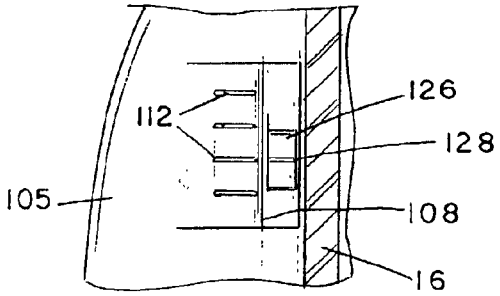
FIG. 17 is a sectional view taken on line 17—17 of FIG. 16.

As in the previous embodiment, the sole plate 105 is a rigid, one piece plate member having a contour which generally follows the contour of the sole of a shoe or boot, and has a first through bore or hole 24 adjacent the toe end 25, and a second through bore or hole 28 in the heel region, both lying on the central longitudinal axis of the sole plate. A first, elongate guide slot 106 is provided across the central region of plate 105 and aligned with the central longitudinal axis of the plate. A first pair of shorter, parallel guide slots 108 are provided in the toe region of the plate on opposite sides of the central axis, and a second pair of parallel guide slots 110 are provided in alignment with the first guide slots 108 in the heel region of the plate. As best illustrated in FIG. 17, a scale 112 is provided along the side of one of each of the guide slots 108 and 110, with different shoe size indications provided by numerals (not illustrated) alongside each scale marking. The sole plate 105 also has a generally rectangular cut out 114 along its outer side edge, and a backslide plate 115, for example the plate as described in my U.S. Pat. No. 6,029,983, may be mounted in cut out 114 as indicated in FIG. 13.

Figure 14:
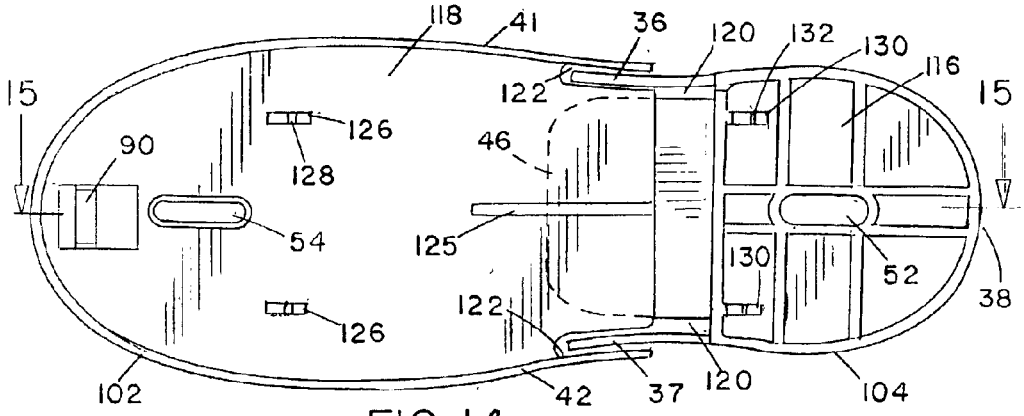
FIG. 14 is a view similar to FIG. 6, showing interlocking elements on the boot toe and heel shells to fit with FIG. 13.
Figure 15:
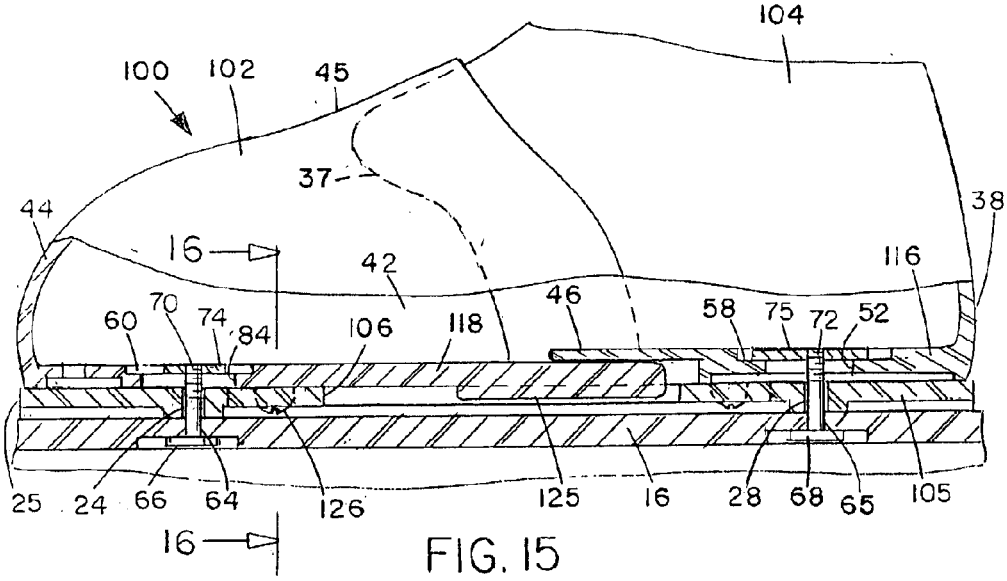
FIG. 15 is a sectional view taken on line 15—15 of FIG. 14.

The heel shell and toe shell are designed to enclose the heel and toe portions, respectively, of a wearer's foot, as in the previous embodiment. The heel shell 104 has an ankle cuff, a sole portion 116, opposite inner and outer side walls 36,37, and a rear end wall 38. The toe shell 102 has a sole portion 118, opposite inner and outer side walls 41,42, and a front or toe end wall 44, as well as an upper wall portion 45 for extending over the toe end of a wearer's foot. A conventional opening (not illustrated) for access of the wearer's foot into the boot will be provided across the top of the boot shell and part of the toe shell, with conventional lacing holes on opposite sides of the opening. The sole portion 116 of the heel shell has a pair of slots 120 adjacent each side wall extending from its forward end, and the sole portion 118 of the toe shell also has a pair of inwardly directed slots 122, one adjacent each side wall. One of the slots 122 adjacent the outer side wall 42 may have an enlarged cut out region (not illustrated) for providing a clearance for the end of the backslide plate attachment bolt 124. When the toe and heel shells are engaged together as indicated in FIGS. 14 and 15, the opposite side walls 36,37 of the heel shell engage inside the corresponding walls 41,42 of the toe shell, and slide into the slots 122, as illustrated in FIG. 14. The opposite side walls 36,37 are flexible so as to accommodate different width portions of a wearer's foot as the size is adjusted, so that they will fit up snug against the inner faces of walls 41,42 and not leave a large gap. The heel and toe shells engage together exactly as described above in connection with the first embodiment.

Figure 16:
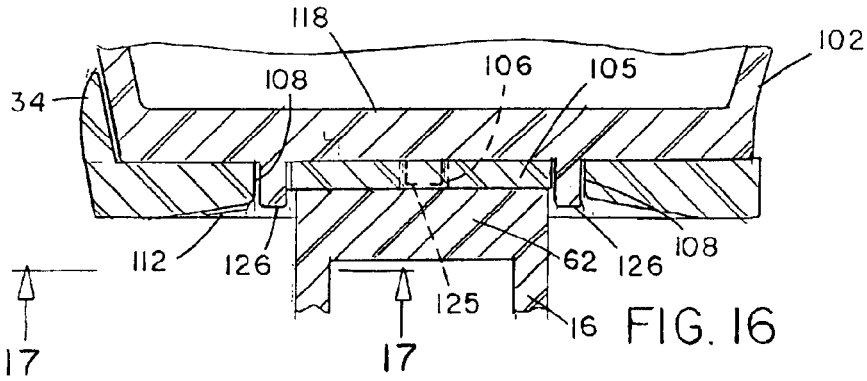
FIG. 16 is an enlarged sectional view taken on line 16—16 of FIG. 15.

The lower surface of the sole portions 116,118 of the heel and toe shells are illustrated in FIG. 14. The lower surface of the sole portion 118 of the toe shell has a centrally located, downwardly directed elongate centering rib 125 for sliding engagement in the central elongate slot 106 in the sole plate 105, as best illustrated in FIG. 15. A pair of downwardly projecting, notched tabs 126 are provided at a location spaced forwardly and on either side of rib 125 for sliding engagement in the shorter guide grooves or slots 108 in the toe region of the sole plate, as indicated in FIGS. 15 and 16. The notches 128 are for alignment with the scale markings 112 to provide an indication of a corresponding boot or shoe size dependent on the position of the toe shell relative to sole plate 105. Similarly, the sole portion 116 of the heel shell has a pair of downwardly projecting tabs 130 with central notches 132 for engagement in the guide slots 110 in the heel region of the sole plate. The tabs and slots act as stabalizers to resist rocking of the shells relative to the sole plate, as well as providing a size indication.

The sole portions of the heel and toe shells also have elongate slots 52,54 for alignment with the respective holes 28,24 in the sole plate, as in the previous embodiment. Bolts 66,68 extend from beneath frame 16 through the two sets of aligned holes 64,24,54 and 65,28,52, respectively, as indicated in FIG. 15, in order to secure the toe and heel shells at selected positions on sole plate 105. Nuts 74,75 are secured to the threaded ends of bolts 66,68 and are located in the recesses 60,58 respectively in the toe and heel shells.

Figure 18:
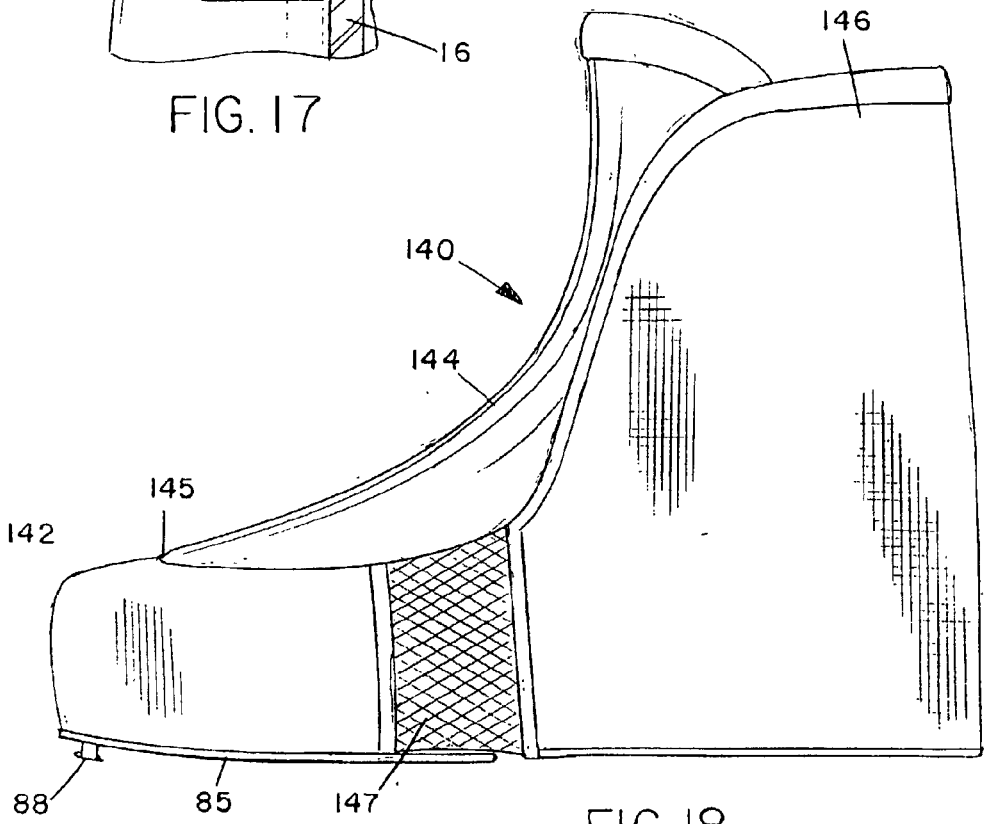
FIG. 18 is a view similar to FIG. 10, showing an alternative liner configuration.

As illustrated in FIGS. 14 and 15, the sole portion 118 of the toe shell in this embodiment is also provided with a latch receiving opening 90 for snap engagement with a latch member 88 secured to the toe of an extendible liner. FIGS. 10 to 12 illustrate one possible liner 80 for insertion in the boot 10 of the previous embodiment, or in the adjustable boot of FIGS. 13 to 17. FIG. 18 illustrates a modified sock or liner 140 for use in the adjustable boot assembly of FIGS. 1 to 9 or that of FIGS. 13 to 17. In the embodiment of FIGS. 10 to 12, the liner has an elastic insert 84 positioned between the toe end of the liner and the tongue or flap which extends over the insertion opening extending from the cuff of the liner down to a location adjacent the end of the illustrated tongue. In this embodiment, the liner opening is extended to a location closer to the toe end 142 of the liner, and the tongue 144 has a forward end 145 secured adjacent the front end of the liner opening and extends rearwardly and upwardly to the top of the cuff portion 146 of the liner. An extendible portion 147 of elastic or stretchable material is inserted in the liner at a location spaced rearwardly from the forward end of the liner opening and tongue 144. Thus, in this embodiment, unlike that of FIGS. 10 to 12, the extendible portion is located between the heel end of the liner and the forward end of the tongue, not between the toe end of the liner and the forward end of the tongue. The remainder of the liner will be of suitably padded material for comfort of the wearer. The extended liner opening and tongue will make it easier for the user to insert their foot into the liner and boot. The plate 85 and latch member 88 secured to the lower surface of the sole of liner 140 are identical to that of the previous embodiment, and like reference numerals have been used as appropriate. Instead of securing plate 85 to the liner with adhesive, it may be sewn or otherwise fastened to the sole of the liner.

The adjustable skate of FIGS. 13 to 17 is assembled in a similar manner to the previous embodiment. The sole plate 105 is placed over the upper wall 62 of frame 16 with the holes 24,28 aligned with holes 64,65. The toe and heel shells are then placed on top of sole plate 105 such that centering rib 125 engages in slot 106, tabs 126 engage in slots 108 at the toe, and tabs 130 engage in slots 110. The elongate slots 54, 52 will be positioned over the respective holes 24,28 in the sole plate. The bolts 66, 68 are then inserted through the respective aligned holes and slots in the frame 16, sole plate 105, and toe and heel shells, respectively, and the nuts 74,75 may be engaged loosely over the projecting, threaded ends 70,72 of the bolts. At this point, the heel and toe shells may be moved back and forth relative to the sole plate until the desired boot size is reached. The toe shell rib 125 and tabs 126 will slide along the respective slots 106,108 to accommodate such adjustment, while the heel shell tabs 130 will slide along slots 110, the length of the slots 108 and 110 determining the maximum possible size adjustment. The user can determine when the heel and toe shells are at the appropriate position corresponding to a desired shoe size by lining up the central notches 128,132 in the toe and heel tabs with the corresponding size markings 112 on the undersurface of sole plate 105, as best illustrated in FIGS. 16 and 17.

The adjustable skate of FIGS. 13 to 17 has additional stability due to tabs engaging in the stabilizing slots in the sole plate, while the centering slot and rib engagement between the sole plate and toe shell helps to position the shells properly and guide them during adjustment. This arrangement avoids the need for full length grooves or slots running the entire length of the sole plate, as in the previous embodiment, and has the advantage that the user can determine the size adjustment by use of the scale markings 112 on the undersurface of the sole plate.

The adjustable in-line skate of this invention permits the boot always to be properly centered relative to the wheels or rollers, since both the heel and the toe shell can be extended in opposite directions relative to the sole plate for adjustment of the overall boot size, permitting the overall boot to remain in a central position. The solid, one-piece sole plate, which is suitably of rigid plastic, metal, or the like, is very stable for grinding maneuvers. Also, the provision of two separate adjustment points, one between the sole plate and heel shell, and one between the sole plate and toe shell, allows for a greater amount of adjustability than the prior art which only had one adjustment point.

Although the sole plate and wheel support frame are formed separately in the illustrated embodiments, it will be understood that these parts may alternatively be formed integrally in one piece. In this case, the upper wall 62 of the wheel support frame will simply be extended outwardly to form an extended, plate-like member of shape corresponding to the shape of the sole plate as illustrated in FIGS. 2 to 5.

Although an exemplary embodiment of the invention has been described above by way of example only, it will be understood by those skilled in the field that modifications may be made to the disclosed embodiment without departing from the scope of the invention, which is defined by the appended claims.

I claim:

1. An adjustable in-line skate, comprising:

a rigid frame;

a plurality of wheels rotatably secured to the frame in a line;

the frame having an upper wall facing away from the wheels;

a one-piece sole plate having a heel portion and a toe portion and a central longitudinal axis, the sole plate being mounted on the upper wall of the wheel frame;

a boot comprising a toe shell and a separate heel shell, each shell having a sole portion and the sole portions together forming a sole of the boot;

a first adjustable securing device adjustably securing the toe shell to the sole plate for allowing adjustment of the position of the toe shell on the sole plate in a direction along the longitudinal axis of the sole plate;

a second adjustable securing device spaced from the first adjustable securing device for adjustably securing the heel shell to the sole plate for allowing adjustment of the position of the heel shell on the sole plate in a direction along the longitudinal axis of the sole plate; and the sole plate being of predetermined peripheral shape and dimensions matching the shape and dimensions of the periphery of the sole of the boot formed by the toe shell and heel shell;

whereby the relative positions of the toe and heel shells on the sole plate can be adjusted in order to vary the overall heel to toe length of the boot.

2. The skate as claimed in claim 1, wherein the heel and toe shells each have a sole portion with a lower surface and the sole plate has an upper surface for engaging the lower surfaces of the sole portions, the lower surface of each shell having at least one guide formation and the upper surface of the sole plate having at least one mating guide formation for sliding engagement with said heel and toe guide formations, said formation extending parallel with the longitudinal axis of the sole plate.

3. The skate as claimed in claim 2, wherein the guide and guide mating formations comprise ribs and grooves, respectively, the upper surface of the sole plate having spaced, parallel guide grooves extending on opposite sides of said longitudinal axis, and the lower surface of each shell having corresponding ribs for sliding engagement in said grooves.

4. The skate as claimed in claim 2, wherein the upper surface of the sole plate has at least one elongate guide slot and the lower surface of the sole portion of at least one of said shells has a downwardly projecting rib for sliding engagement in said guide slot.

5. The skate as claimed in claim 4, wherein said guide slot is on the central longitudinal axis of the sole plate.

6. The skate as claimed in claim 2, wherein the heel portion and toe portion of the sole plate each have a pair of parallel guide slots comprising said guide formations, the sole portion of each of the shells having a pair of downwardly directed tabs for sliding engagement in the respective guide slots.

7. The skate as claimed in claim 6, wherein the sole plate has scale markings along at least one of the guide slots in the heel and toe portion for indicating boot size based on the adjusted positions of the heel and toe shells on the sole plate.

8. An adjustable in-line skate, comprising:

a rigid frame;

a plurality of wheels rotatably secured to the frame in a line;

the frame having an upper wall facing away from the wheels;

a one-piece sole plate having a heel portion and a toe portion and a longitudinal axis, the sole plate being mounted on the upper wall of the wheel frame;

a boot comprising a toe shell and a separate heel shell;

a first adjustable securing device adjustably securing the toe shell to the sole plate for allowing adjustment of the position of the toe shell on the sole plate in a direction along the longitudinal axis of the sole plate;

a second adjustable securing device spaced from the first adjustable securing device for adjustably securing the heel shell to the sole plate for allowing adjustment of the position of the heel shell on the sole plate in a direction along the longitudinal axis of the sole plate; and the upper wall of the frame, the sole plate, and the heel shell having a first set of aligned openings and the upper wall of the frame, the sole plate, and the toe shell having a second set of aligned openings, the openings in the heel and toe shells each being elongated in the axial direction, and the first and second adjustment devices comprise first and second bolts extending through the first and second sets of aligned openings, respectively;

whereby the relative positions of the toe and heel shells on the sole plate can be adjusted in order to vary the overall heel to toe length of the boot.

9. An adjustable in-line skate, comprising:

a rigid frame;

a plurality of wheels rotatably secured to the frame in a line;

the frame having an upper wall facing away from the wheels;

a one-piece sole plate having a heel portion and a toe portion and a longitudinal axis, the sole plate being mounted on the upper wall of the wheel frame;

a boot comprising a toe shell and a separate heel shell;

a first adjustable securing device adjustably securing the toe shell to the sole plate for allowing adjustment of the position of the toe shell on the sole plate in a direction along the longitudinal axis of the sole plate;

a second adjustable securing device spaced from the first adjustable securing device for adjustably securing the heel shell to the sole plate for allowing adjustment of the position of the heel shell on the sole plate in a direction along the longitudinal axis of the sole plate; and each shell having an inner end facing the other shell, the inner end of one shell having recesses and the inner end of the other shell having outwardly projecting tongues for sliding engagement in said recesses as the relative positions of the shells are adjusted;

whereby the relative positions of the toe and heel shells on the sole plate can be adjusted in order to vary the overall heel to toe length of the boot to any selected adjusted length between a maximum length and a minimum length;

the heel and toe shells overlapping to form a continuous boot shell at any adjusted length between said maximum and minimum lengths.

10. An adjustable in-line skate, comprising:

a rigid frame;

a plurality of wheels rotatably secured to the frame in a line;

the frame having an upper wall facing away from the wheels;

a one-piece sole plate having a heel portion and a toe portion and a longitudinal axis, the sole plate being mounted on the upper wall of the wheel frame;

a boot comprising a toe shell and a separate heel shell;

a first adjustable securing device adjustably securing the toe shell to the sole plate for allowing adjustment of the position of the toe shell on the sole plate in a direction along the longitudinal axis of the sole plate;

a second adjustable securing device spaced from the first adjustable securing device for adjustably securing the heel shell to the sole plate for allowing adjustment of the position of the heel shell on the sole plate in a direction along the longitudinal axis of the sole plate;

whereby the relative positions of the toe and heel shells on the sole plate can be adjusted in order to vary the overall heel to toe length of the boot to any selected adjusted length between a maximum length and a minimum length; and each shell having an inner end opening, the inner end opening of one shell engaging over the other shell to form a continuous boot interior at all adjusted length positions between said maximum and minimum length.

11. An in-line skate, comprising:

a rigid sole plate having an outer periphery of shape matching the periphery of the sole of a boot, the plate having a central longitudinal axis, an upper face and a lower face;

a wheel supporting frame secured to the lower face of the sole plate;

a plurality of wheels rotatably secured to the frame in a line; and a boot comprising a toe shell and a separate heel shell;

the heel and toe shells being separately and adjustably secured to the sole plate for adjustment of the overall length of the boot.

12. The skate as claimed in claim 11, wherein the sole plate and wheel supporting frame are formed integrally.

13. The skate as claimed in claim 11, wherein the sole plate and wheel supporting frame are formed as two separate parts.

14. The skate as claimed in claim 11, wherein the sole plate has first pair of openings at spaced positions along the central longitudinal axis of the plate, and the boot has a second pair of spaced openings for alignment with the respective openings in the sole plate, the heel and toe shells each having a sole portion for mounting over a respective heel and toe portion of the sole plate, one of said second pair of openings being located in the sole portion of the heel shell and the other of said second pair of openings being located in the sole portion of the toe shell, and first and second releasable fasteners extend through the respective aligned openings for releasably securing the heel and toe shells to the sole plate, one of said pairs of openings being elongated in the axial direction for permitting adjustment of the position of each shell relative to said sole plate, and said releasable fasteners comprising means for releasably locking each shell in a selected adjusted position.

15. The skate as claimed in claim 11, wherein the sole plate has at least one elongate guide formation and each shell has at least one guide tab for sliding engagement in a guide formation in the sole plate, the sole plate having a lower surface with a size indicating scale for alignment with at least one of said guide tabs to indicate the adjusted boot size.

16. The skate as claimed in claim 15, wherein the sole plate has at least two elongate guide slots comprising guide formations, and each guide tab engages in a respective one of said guide slots.

17. An in-line skate, comprising:

a rigid sole plate having an outer periphery of shape substantially matching the periphery of the sole of a boot, the plate having a central longitudinal axis, an upper face and a lower face;

a wheel supporting frame secured to the lower face of the sole plate;

a plurality of wheels rotatably secured to the frame in a line; and a boot comprising a toe shell and a separate heel shell;

the heel and toe shells being separately and adjustably secured to the sole plate for adjustment of the overall length of the boot; and the toe shell having a sole portion having a toe end corresponding to a toe end of the boot, and the sole portion having a latch opening adjacent the toe end for releasable latching engagement with a latch element on a boot lining sock.

18. An in-line skate, comprising:

a rigid sole plate having an outer periphery of shape substantially matching the periphery of the sole of a boot, the plate having a central longitudinal axis, an upper face and a lower face;

a wheel supporting frame secured to the lower face of the sole plate;

a plurality of wheels rotatably secured to the frame in a line;

a boot comprising a toe shell and a separate heel shell;

the heel and toe shells being separately and adjustably secured to the sole plate for adjustment of the overall length of the boot;

a liner of pliable, soft material for fitting into the boot for receiving a wearer's foot and cushioning the foot against internal surfaces of the boot, the liner having a toe end, a heel end, and a lower surface, and including at least one portion of stretchable material to allow the liner to be extended to accommodate variations in the length of the boot; and a plate member of rigid material secured to the lower surface of the liner adjacent the toe end of the liner, the plate member having a downwardly projecting latch element, and the toe shell having a sole portion with a latch opening for releasable latching engagement with said latch element to secure the toe end of the liner to the toe shell.

19. An in-line skate, comprising:

a rigid sole plate having an outer periphery of shape substantially matching the periphery of the sole of a boot, the plate having a central longitudinal axis, an upper face and a lower face;

a wheel supporting frame secured to the lower face of the sole plate;

a plurality of wheels rotatably secured to the frame in a line;

a boot comprising a toe shell and a separate heel shell;

the heel and toe shells being separately and adjustably secured to the sole plate for adjustment of the overall length of the boot; and each shell having an inner end opening facing the other shell, and opposite side walls, the inner end opening of the toe shell extending over the side walls of the inner end opening of the heel shell, the side walls of the heel shell being of flexible material to accommodate the varying width of the boot as the boot size is adjusted.

20. The skate as claimed in claim 19, wherein each shell has a sole portion, each sole portion having a slot extending from the inner end of the shell adjacent each side wall, the side walls of the heel shell engaging in the slots in the sole portion of the toe shell, the width of the toe shell initially increasing from the inner end of the shell towards the toe end of the shell, and the side walls of the heel shell flexing outwardly along said slots to accommodate said increasing width as the toe shell is moved farther inwardly over the heel shell to decrease the boot size.

* * * * *